United States Patent [19]

Aeschliman

[11] 4,089,573

[45] May 16, 1978

[54] HINGE ASSEMBLY FOR MOUNTING SEWING MACHINE IN CABINET

[75] Inventor: Eugene Aeschliman, Jackson, Miss.

[73] Assignee: DeSoto, Inc., Des Plaines, Ill.

[21] Appl. No.: 765,993

[22] Filed: Feb. 7, 1977

[51] Int. Cl.[2] ..... A47B 81/00

[52] U.S. Cl. ..... 312/27; 312/21; 312/26; 112/217.1

[58] Field of Search ..... 112/217.1; 312/21, 24, 312/26, 27–30; 248/280, 281, 292, 378, 376, 421, 23

[56] References Cited

U.S. PATENT DOCUMENTS

| | | | |
|---|---|---|---|
| 2,153,705 | 4/1939 | Andersen | 248/23 |
| 2,966,760 | 1/1961 | Brockway | 248/188.2 |
| 3,986,755 | 10/1976 | Kohara | 312/21 |
| 4,018,487 | 4/1977 | Orr et al. | 312/21 |

*Primary Examiner*—Casmir A. Nunberg

*Attorney, Agent, or Firm*—Arnstein, Gluck, Weitzenfeld & Minow

[57] ABSTRACT

A hinge assembly for mounting a sewing machine in a cabinet includes means for adjusting the attitude of the machine in relation to the table top of the cabinet, in order to compensate for variations in structural tolerances of the hinge assembly and the cabinet, so that the machine when used either in a free-arm or flat-bed mode is disposed in accurate registration with the table top.

4 Claims, 6 Drawing Figures

HINGE ASSEMBLY FOR MOUNTING SEWING MACHINE IN CABINET

BACKGROUND OF THE INVENTION

The present invention relates to a hinge assembly for mounting a sewing machine in a cabinet.

A type of sewing machine currently in popular use is selectively convertible for use in a flat-bed or free-arm mode. The machine is mounted on a hinge assembly which controls the attitude of the machine in its movement from storage position to flat-bed and free-arm mode of operation. Desirably, the sewing machine, in either mode of operation, should assume a level position in relation to the table top work surface of the cabinet. The structural character of the linkage arrangement utilized in the hinge assembly, together with the dimensional tolerances of the components of the hinge assembly and the cabinet, make it extremely difficult to produce a commercial hinge assembly which will position the sewing machine so that in both modes of operation it will be level in relation to the table top and in accurate registration therewith.

SUMMARY OF THE INVENTION

One of the objects of this invention is the provision, in a hinge assembly for mounting a sewing machine in a cabinet, of means for adjusting the attitude of the machine to compensate for deficiencies in the hinge assembly and the dimensional tolerances in the hinge components and cabinet so that in any mode of operation it is level in relation to the work surface of the cabinet and in accurate registration therewith.

Other and further objects and advantages of this invention will become apparent from the following description when considered in connection with the accompanying drawings.

BRIEF DESCRIPTION OF A PREFERRED EMBODIMENT

BRIEF DESCRIPTION OF A PREFERRED EMBODIMENT

Figure 1:
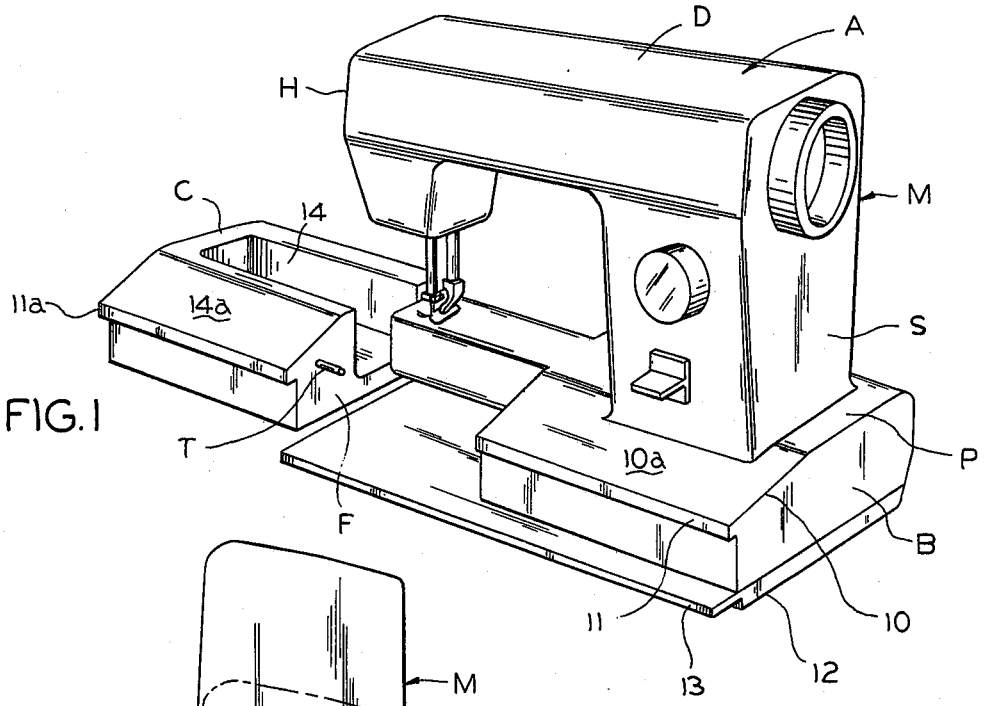
FIG. 1 is a perspective view of a convertible sewing machine of the type utilized with my invention, showing the components in exploded relation.

Referring to FIG. 1, there is illustrated a sewing machine M which is convertible for use, either as a free-arm or as a flat-bed type. This machine forms no part of the present invention, but for a clear understanding of the invention, certain features of the machine will be described briefly below.

The machine M comprises a hollow base B, shaped substantially as shown, and having a work supporting surface or bed plate P. Secured to the base B is a head A which includes a vertically disposed hollow standard S carrying an overhanging arm D terminating in a hollow head H in which is mounted a reciprocatory needle bar and presser bar. Base B is generally T-shaped, in plan, and includes a main body portion 10 and a longitudinally extending integral arm 11 of reduced width disposed in vertical registration with the overhanging arm D. Conventional loop taker and feed mechanisms, not shown, are housed within the base B. The body portion 10 of base B includes a forward downwardly inclined work surface 10*a* having an overhanging flange 11 forming a longitudinally extending shoulder.

Base B is supported on a rectangular platform plate 12 having an overhanging flange 13 coextensive with its forward edge and providing a longitudinally extending shoulder. While the main body portion 10 of base B is supported on plate 12, the bottom wall of arm 11 is spaced upwardly from the base plate 12 so as to provide clearance between the arm 11 and plate 12 to permit the machine to function in a free-arm mode, as will be hereinafter explained.

A base shoe C, shaped substantially as illustrated in FIG. 1, is constructed to be complemental to base B. Said shoe includes a recess 14 adapted to receive the arm 11 and an inclined work surface 14*a* having an overhanging flange 11*a*. When the shoe C is assembled to the base B, the respective horizontal and inclined surfaces of the base and shoe are in coplanar registration affording a continuous work supporting surface and also a continuous longitudinally extending shoulder 11, 11*a* for a purpose as will be hereinafter explained. The shoe C is provided with at least two pins T which project from the side face F, the pins being adapted to be received in cooperating holes in the confronting face of base B for purposes of alignment and securement of the shoe C to base B.

The hinge assembly 15 of my invention comprises a U-shaped bracket 16, preferably formed of sheet metal, and including a rear wall 17 and spaced side walls 18, 18. Each of the walls 18 is provided with a perforated flange 19 to receive screw means for fastening the bracket to the underside of the top of a conventional sewing machine cabinet L.

Figure 4:
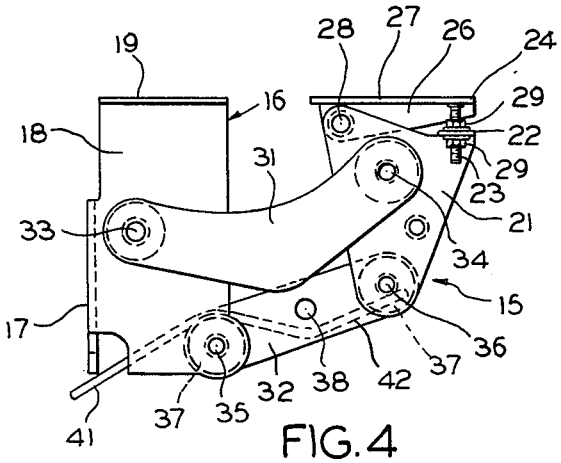
FIG. 4 is a side elevational view of the hinge assembly.
Figure 5:
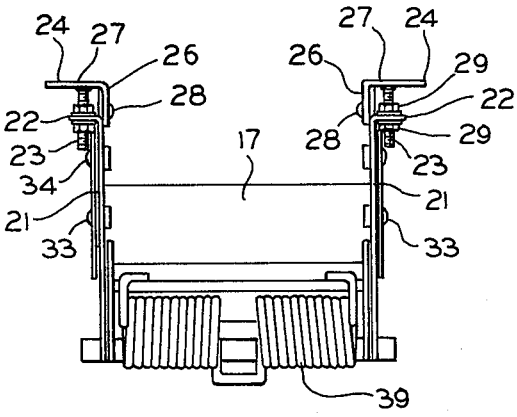
FIG. 5 is an end elevational view of the hinge assembly.

Each of a pair of brackets 21, 21 also formed of sheet metal and shaped generally triangular, is provided with a laterally directed lug 22 which is perforated to receive a threaded member 23, presently to be described. A support member 24, shaped substantially as illustrated in FIGS. 4–5, includes a vertical leg 26 and a horizontal leg 27. The vertical leg 26 is perforated at one end to receive a headed pin 28 which passes through an aperture in an opposite corner of the bracket 21. As will be apparent, the support member 24 is rockable about the axis of pin 28 relative to the bracket 21. The threaded member 23 has a head portion which is welded or otherwise securely fixed to the horizontal leg 27. Each threaded member 23 is provided with a pair of lock nuts 29 which are disposed on opposite sides of the lug 22 and which, when tightened, fix the supporting member 24 in an adjusted position relative to the bracket 21.

Figure 3:
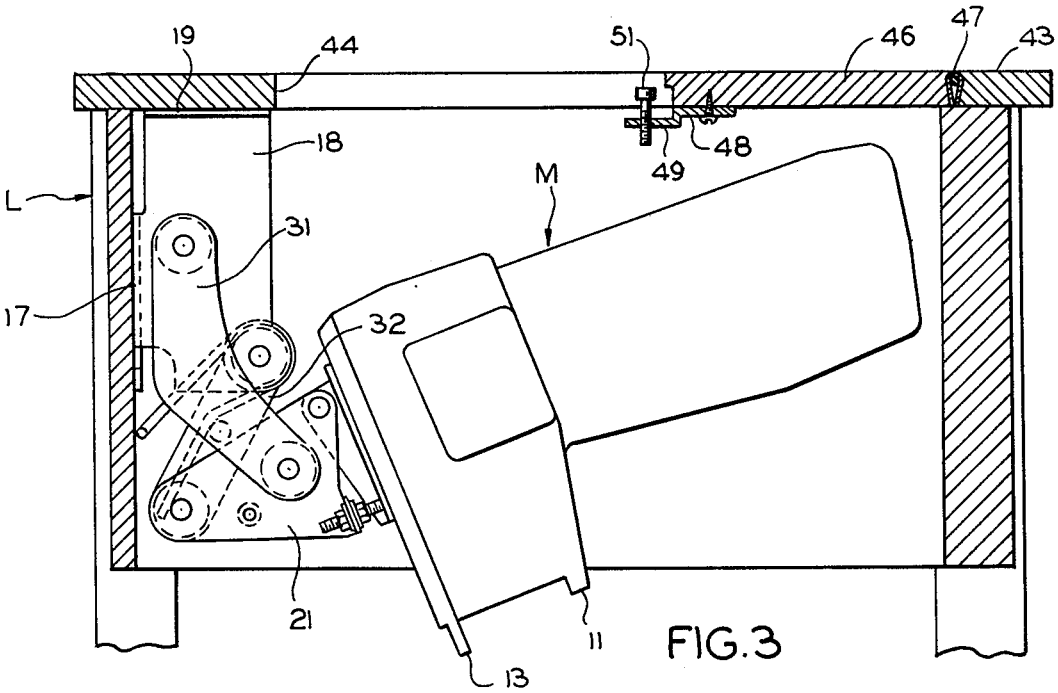
FIG. 3 is a view similar to FIG. 2 showing the machine disposed in storage position within the cabinet.

The brackets 18, 18 and 21, 21 are connected by two pairs of links 31, 31 and 32, 32. The links 31, 31 are formed of sheet metal and shaped substantially as illustrated in FIGS. 3 and 4. Each of the links 31 has a hole at each end and is connected at respective ends to the brackets 16 and 21 by headed pins 33 and 34.

Figure 6:
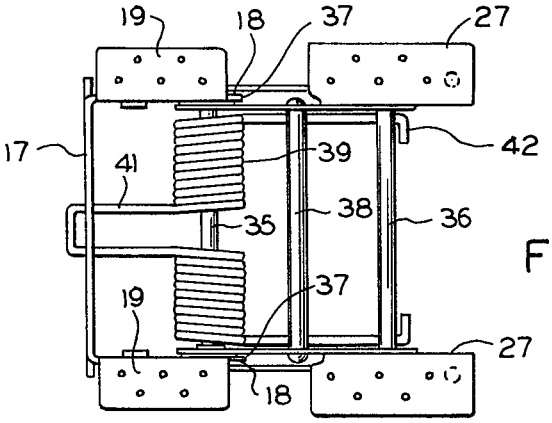
FIG. 6 is a top plan view of the same.

Each of the links 32 has a hole at each end and is connected to respective brackets 16 and 21 by shafts 35 and 36 which extend between the links 32. Suitable washers 37 are interposed between the links 31, 32 and brackets 16, 21 at the points of connection. A spacer bar 38 extends between the links 32 to afford rigidity to the structure. A torsion spring 39 formed in two connected sections, as illustrated in FIG. 6, has two coils circumposed about shaft 35 and includes oppositely directed radially extending arms 41 and 42, the arm 41 abutting against the rear wall of the cabinet L while the arm 42 abuts the transverse shaft 36. The spring 39 provides a counter-effect against the weight of the sewing machine M to assist the operator in elevating the machine to its operative positions.

Figure 2:
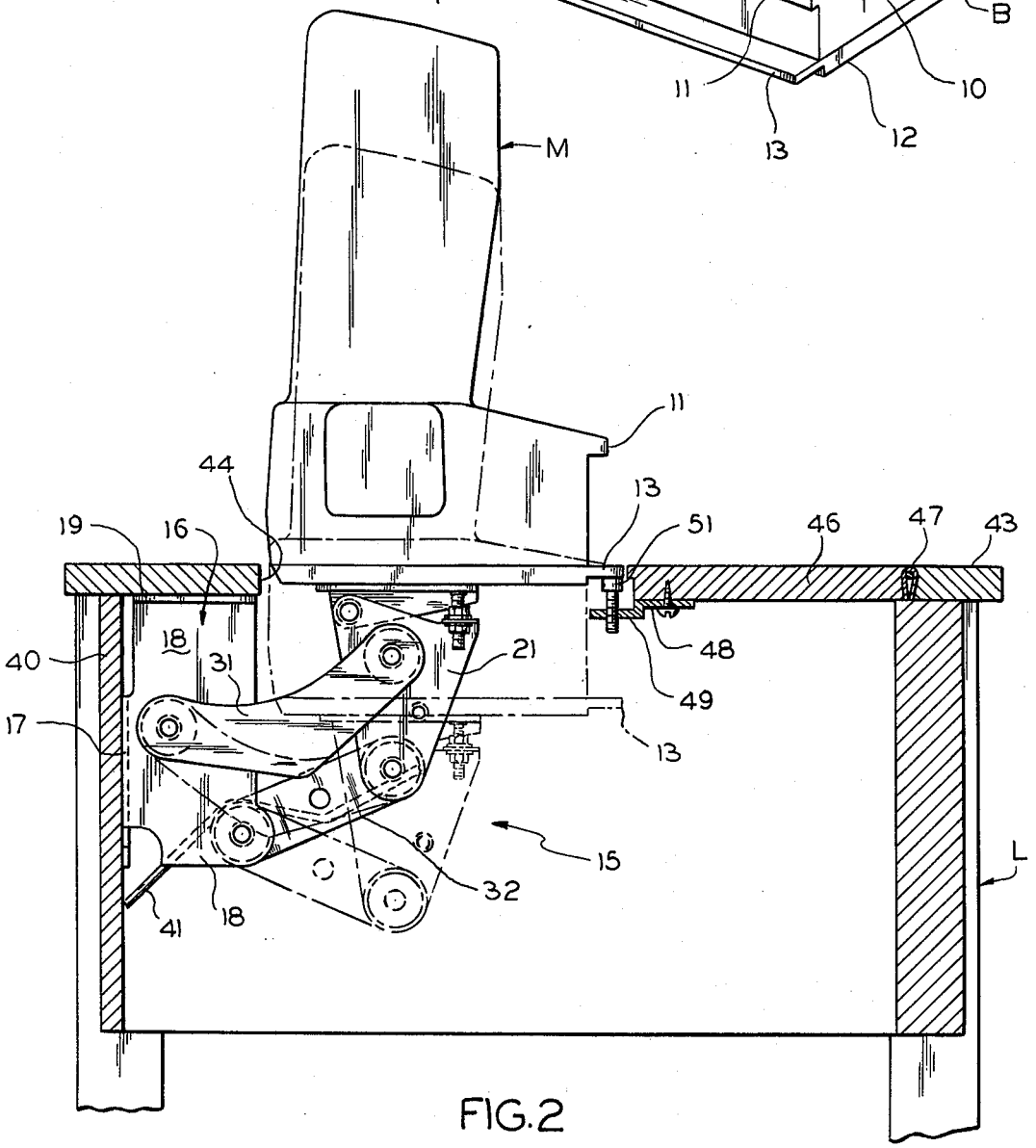
FIG. 2 is a vertical cross-sectional view through a sewing machine cabinet, with the hinge assembly of my invention mounted thereon, and showing, in solid and broken lines, the machine disposed in free-arm and flat-bed modes of operation.

As illustrated in FIGS. 2 and 3, the machine M is rested on and secured to the support members 27 by suitable fastening elements. The brackets 16 are secured to the under surface of the table top 43 of the cabinet L, in the manner illustrated.

Referring to FIGS. 2 and 3, the cabinet L is of generally conventional construction and includes a table top 43 provided with a rectangular cut-out 44 and having a movable panel 46 extending the full width of the cut-out and hinged, as at 47, to the table top 43. Suitable stop elements, not shown, are secured to the side walls of the cabinet L for supporting the panel 46 in a horizontal position. The panel 46 has attached to its free edge a pair of adjustable self-levellers 48 comprising brackets 49 and adjusting screws 51 arranged to receive either of the flanges 11 or 13 of the machine, as will be hereinafter explained.

As indicated by the solid lines in FIG. 2, the machine M is shown in its uppermost position with the flange 13 supported on the heads of the adjustable screws 51 and, in this position, the machine may be operated in a free-arm mode, after the shoe C is separated from the machine by sliding the same laterally, as illustrated in FIG. 1. It will be noted that in this position the bottom of the arm 11 is disposed above the surface of the table top 43 and panel 46, affording desired clearance for operation of the machine in a free-arm mode. In order to convert the machine to operation in a flat-bed mode, the machine M is elevated a short distance just sufficient to permit the operator to tilt the panel 46 upwardly clear of the flange 13. Thus, the opening 44 is enlarged to permit the machine M to be lowered into the space of the cabinet. After the flange 13 clears the level of the table top 43, the panel 46 is permitted to resume its normal horizontal at rest position so that when the machine M is further lowered to the broken line position illustrated in FIG. 2, the flange 11 will engage the heads of the adjusting screws 51 and the machine will be supported in a flat-bed mode. It will, of course, be understood that in such mode the shoe C is assembled with the machine M so as to afford a continuous work supporting surface.

The links 31 and 32 control the movement of the machine M in a vertical direction, so that the machine in being moved from the solid line to the broken line positions illustrated in FIG. 2, and vice versa, maintains a generally erect position. However, the dimensional tolerances of the parts of the hinge assembly 15 and of the cabinet L may be such that the flanges 11 or 13 will not register accurately with the top surfaces of the adjusting screws 51 or the machine will not assume a desired erect position. In such event, the attitude of the machine may be adjusted by varying the position of each support member 24 relative to a bracket 21. This is accomplished by loosening the lock nuts 29 to adjust the effective length of the threaded member 23 and then tightening the nuts 29 in adjusted position.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In combination, a hinge assembly for mounting a sewing machine on a cabinet, comprising a first pair of spaced brackets secured to said cabinet, a second pair of spaced brackets, upper and lower pairs of spaced links pivotally secured to said first and second pairs of brackets to afford a parallelogram-like linkage arrangement, a support member pivotally secured at one end proximate to the upper end of each of one of said second pair of spaced brackets and providing generally horizontal support surfaces on which the machine is rested, means for securing a sewing machine on said support surfaces, and means for adjusting the angular relation of each of said support members relative to a respective one of said second pair of brackets to adjust the horizontal position of said machine relative to said cabinet.

2. The invention as defined in claim 1 in which the adjusting means comprises a threaded member interposed between a support member and a respective one of said second pair of brackets.

3. The invention as defined in claim 2 in which the threaded member is fixed to the support member and extends through an aperture in said bracket and including at least one lock nut cooperating with said threaded member.

4. A hinge assembly for mounting a sewing machine on a cabinet comprising a first pair of spaced fixed members secured to said cabinet, a second pair of spaced movable members, upper and lower pairs of links pivotally connected at their ends to said fixed and movable members, the improvement comprising a support member pivotally secured to the upper portion of each movable member, said support member including a horizontal flange on which a body to be supported is rested, each movable member including a lateral lug having a hole therein, a threaded rod depending from each of said flanges and extending through a hole in a respective lug, and at least one lock nut carried on each of said threaded rods and engaged with a respective lug for affording adjustment of the angular relation between each support member and a respective movable member so as to adjust the position of said body carried on said support members.

* * * * *